United States Patent [19]

Wilson

[11] Patent Number: 4,638,863

[45] Date of Patent: Jan. 27, 1987

[54] WELL PRODUCTION METHOD USING MICROWAVE HEATING

[75] Inventor: Robert Wilson, Plano, Tex.

[73] Assignee: Atlantic Richfield Company, Los Angeles, Calif.

[21] Appl. No.: 878,147

[22] Filed: Jun. 25, 1986

[51] Int. Cl.[4] ..... E21B 36/00; E21B 43/24

[52] U.S. Cl. ..... 166/248; 166/60; 166/302

[58] Field of Search ..... 166/248, 60, 65.1, 302; 219/10.55 R, 10.55 A, 10.55 M, 277, 278

[56] References Cited

U.S. PATENT DOCUMENTS

| | | | |
|---|---|---|---|
| 2,757,738 | 8/1956 | Ritchey | 166/248 |
| 3,170,519 | 2/1965 | Haagensen | 166/65.1 X |
| 4,144,935 | 3/1979 | Bridges et al. | 166/60 X |
| 4,193,448 | 3/1980 | Jeambey | 166/66.4 X |
| 4,228,853 | 10/1980 | Harvey et al. | 166/248 |
| 4,320,801 | 3/1982 | Rowland et al. | 166/248 |

FOREIGN PATENT DOCUMENTS

| | | | |
|---|---|---|---|
| 1031689 | 9/1974 | Canada | 166/248 |
| 2427031 | 12/1975 | Fed. Rep. of Germany . | |

*Primary Examiner*—Stephen J. Novosad
*Attorney, Agent, or Firm*—Roderick W. MacDonald

[57] ABSTRACT

A method for stimulating the production of hydrocarbonaceous fluid from a subterranean geologic formation in the earth during microwave heating of same wherein a portion of high electrical conductivity non-hydrocarbonaceous fluid present in the formation near the wellbore in which microwave heating is taking place is displaced away from the wellbore to substantially reduce the overall electrical conductivity of the formation and its contained fluids in a finite volume around the wellbore thereby increasing the effectiveness of the microwave heating in such finite volume and stimulating the movement of desired hydrocarbonaceous fluid in such finite volume for recovery purposes.

10 Claims, 4 Drawing Figures

WELL PRODUCTION METHOD USING MICROWAVE HEATING

BACKGROUND OF THE INVENTION

Heretofore it has been proposed to employ microwave radiation either from microwave devices on the earth's surface or disposed in a wellbore in the earth to heat a hydrocarbonaceous fluid containing reservoir and the hydrocarbonaceous fluid itself to render the fluid more mobile and therefore, more easily produced from the reservoir formation into a wellbore for production to and recovery at the earth's surface. Such microwave heating techniques and the apparatus necessary for practicing same are well-known to those skilled in the art, see U.S. Pat. No. 3,170,519 issued Feb. 23, 1985 and U.S. Pat. No. 4,193,448 issued Mar. 18, 1980.

BRIEF SUMMARY OF THE INVENTION

In accordance with this invention, production of hydrocarbonaceous fluid from a geologic formation in the earth is stimulated using microwave heating in a conventional manner but the effectivenss of such microwave heating is substantially increased in accordance with this invention by displacing from around the wellbore or wellbores in which microwave heating is to be practiced, at least a portion of any high electrical conductivity, non-hydrocarbonaceous fluid fluid, e.g., salt water, which is normally present in the formation with the hydrocarbonaceous fluid.

By displacing at least a significant portion of this non-hydrocarbonaceous fluid away from the wellbore and further into the reservoir formation, the overall electrical conductivity of the formation from which the non-hydrocarbonaceous fluid has been displaced is increased thereby allowing for more effective heating of the formation and its contained hydrocarbonaceous fluid than if the non-hydrocarbonaceous fluid was allowed to remain in place.

Thus, by this invention more effective heating due to direct and indirect microwave radiation heating is applied to the hydrocarbonaceous fluid itself thereby substantially mobilizing same for flow out of the formation into one or more wellbores than would be obtained if the microwave heating were carried out with all of the normally occuring, non-hydrocarbonaceous fluid present and undisplaced. Accordingly, it is an object of this invention to provide a new and improved method for stimulating the production of hydrocarbonaceous fluid from a subterranean geologic formation in the earth.

Another object is to provide a new and improved method for carrying out microwave heating in a wellbore to stimulate the production of hydrocarbonaceous fluid from a formation penetrated by the wellbore.

Other aspects, objects and adjantages of this invention will be apparent to those skilled in the art from this disclosure and the appended claims.

DETAILED DESCRIPTION

Figure 1:
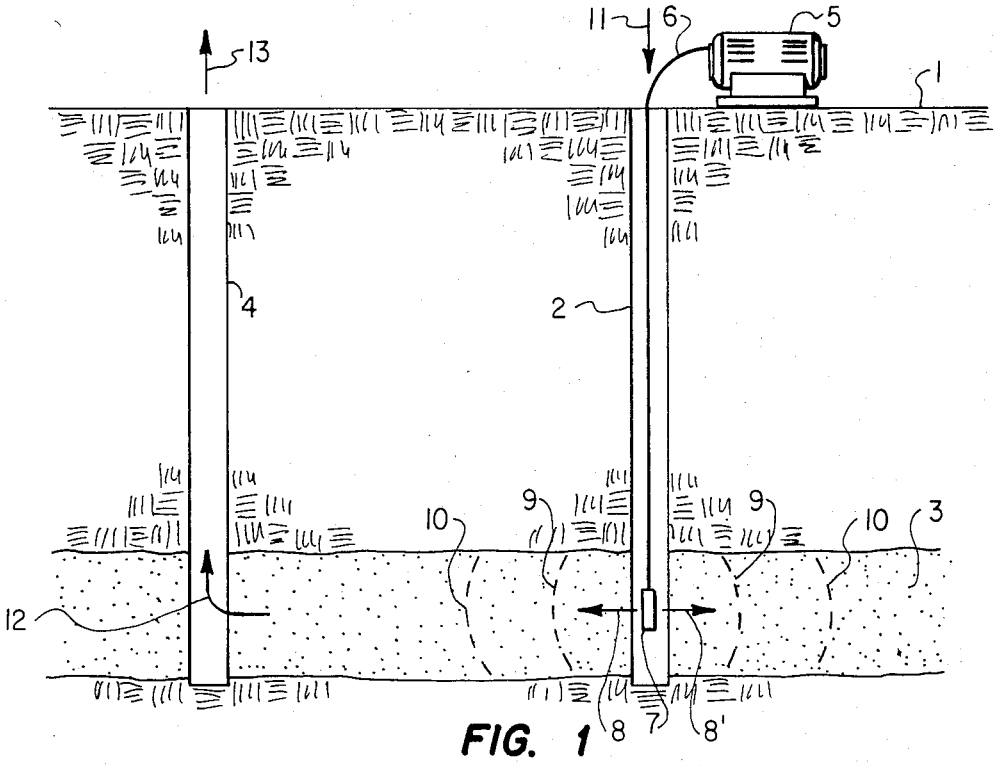
FIG. 1 is a cross sectional view of a wellbore which penetrates a hydrocarbonaceous fluid containing subterranean geologic formation.

More specifically, in accordance with this invention there is provided a method for stimulating the production of hydrocarbonaceous fluid from a subterranean geologic formation in the eath which contains both a hydrocarbonaceous fluid and a non-hydrocarbonaceous fluid which has a higher electrical conductivity than the hydrocarbonaceous fluid. The formation has at least one wellbore penetrating same and microwave heating being employed at the surface of or in at least one of such wellbores to heat the formation and hydrocarbonaceous fluid contained therein to enhance the fow of hydrocarbonaceous fluid into at least one of said wellbores for recovery at the surface of the earth.

In accordance with this invention, before or during or both before and during the microwave heating step at least a portion of the non-hydrocarbonaceous fluid (which is normally present in the formation along with the hydrocarbonaceous fluid) near and around at least one of said wellbores is displaced away from said wellbore and further into said formation to create a finite volume of formation around the subject wellbore which has a substantial amount of normally present non-hydrocarbonaceous fluid removed therefrom. This way the overall electrical conductivity of this finite volume of formation and its contained displacement and hydrocarbonaceous fluid is substantially reduced. This substantial reduction in overall electrical conductivity increases the effectiveness of heating of the microwave radiation in said finite volume so that more microwave heating affects the hydrocarbonaceous fluid in said finite volume and stimulates the movement of such hydrocarbonaceous fluid in the formation. Consequently, the flow of such fluid into one or more wellbores for production to and recovery at the earth's surface is substantially enhanced.

Normally in a geologic formation which contains desired hydrocarbonaceous fluids such as natural gas, crude oil, viscous crude oil, tar, bitumen and the like, and mixtures of two or more thereof, there is also present in substantial quantity, at least one non-hydrocarbonaceous fluid such as salt water which has a substantially higher electrical conductivity than the hydrocarbonaceous fluid. The presence of this high electrical conductivity fluid reduces the desired heating effect of the microwave radiation being imposed on the formation and its contained fluid so that removal of all or at least a substantial portion of such non-hydrocarbonaceous fluid enchances the heating effect of the microwave radiation.

Further, the magnitude of hydrocarbon reserve around a given wellbore is proportional to the square of distance the hydrocarbon is from the wellbore so that a small lateral extension of the microwave heating effect away from the wellbore and out into the formation increases the volume of hydrocarbon thus affected by the microwave heating to a very large extent. For example, if the microwave radiation can be made to be effective forty feet away from the wellbore instead of twenty feet away from the wellbore, the volume of hydrocarbon affected by the heating is increased by a factor of four. By this invention, therefore, not only is the existing heating effect of the microwave radiation improved, but also, the distance this heating effect reaches away from a given wellbore is increased substantially. Thus, not only is better heating achieved by this invention, but a substantially greater volume of formation and hydrocarbonaceous fluid is subjected to the desirable affects of the microwave heating process.

By this invention, since it is based upon a fluid displacement mechanism, one skilled in the art can create the desired enlarged finite zone of effective microwave heating, and, at the same time, if desired, can tailor the configuration of such zone by controlled fluid injection techniques well known in the art. The zone can thus be controlled to conform to any desired shape or size, depending upon the physical characteristics of the formation itself and the presence or absence of subsurface heterogeneities.

In creating a finite volume of lower electrical conductivity in accordance with this invention, the higher electrical conductivity, non-hydrocarbonaceous fluid which is displaced can be displaced by either gas or liquid injection or injection of a mixture of liquid and gas much in the manner that is already well-known in the art as secondary and tertiary recovery techniques for hydrocarbons. Injection of a gas, such as natural gas, for displacing nonhydrocarbonaceous fluid, has the advantage that the gas can be readily separated from produced hydrocarbonaceous liquids for re-use in the process. However, there are times when the injection of liquid displacing fluid is preferable. If the hydrocarbonaceous fluid normally present in the formation is viscous, such as in the case of viscous crude oil or tar sands formations, a liquid displacing fluid can be used for multiple effects. For example, the liquid displacing fluid not only can be designed to displace non-hydrocarbonaceous fluid away from the wellbore, but also can be made to serve as a diluent for the viscous hydrocarbonaceous fluid already present. This way the diluted hydrocarbonaceous fluid is mobilized not only by heating as a result of microwave radiation, but also by physical or chemical dilution of the viscous fluid by the less viscous displacement fluid which is preferably miscible with the hydrocarbonaceous fluid. The design of a displacing fluid which is miscible with a hydrocarbonaceous fluid already present in a formation is well-known in the art and will not be described further here for sake of brevity. It should be understood, however, that miscible type displacing fluids, as well as other fluids well-known in the tertiary recovery art, e.g., micellar fluids, can be employed in this invention to further enhance the stimulation of production of hydrocarbonaceous fluids from the subject formation in addition the enhancement that is achieved solely due to microwave heating.

The non-hydrocarbonaceous fluid can be displaced in the formation in any manner which achieves the desired result of substantially reducing the overall electrical conductivity of a finite volume of the subject formation and its contained fluids. The presently preferred method for achieving such displacement is by injection into the formation of a gas and/or liquid which is hydrocarbonaceous in nature. However, it is neither the scope of this invention to inject any fluid (gas and/or liquid) which achieves the desired displacement result while lowering the overall electrical conductivity of the formation and its contained fluids without adversely affecting the reservoir rock itself. In this invention, the term "hydrocarbonaceous" means a fluid which is primarily, although not necessarily completely, hydrocarbon in nature. For example, the displacing fluid need not be entirely a hydrocarbon but can contain minor amounts of non-hydrocarbon enities such as oxygen, nitrogen, and the like. For example, a hydrocarbonaceous displacing fluid, besides being antural gas or a strictly hydrocarbon containing liquid, can be or can contain hydrocarbonaceous materials such as alcohols, glycols, ammonium containing compounds, and the like so long as the displacing fluid has a substantially lower electrical conductivity than the non-hydrocarbonaceous fluid it is displacing and is nondeleterious to the formation itself.

Although not critical to the benefical results of this invention, it is presently preferred that the displacing fluid have an electrical conductivity at least fifty percent lower than the electrical conductivity of the non-hydrocarbonaceous fluid it is displacing. When an essentially liquid hydrocarbonaceous fluid is employed as a displacing fluid, it is preferred that the displacing fluid have a viscosity greater than the viscosity of the non-hydrocarbonaceous fluid it is displacing and at the same time, a viscosity which is less than the viscosity of the hydrocarbonaceous fluid already present in the formation.

Further, in carrying out the process of this invention it is preferred that sufficient non-hydrocarbonaceous fluid is displaced from the finite volume of formation around the wellbore to reduce by at least about ten percent, preferably at least about twenty-five percent, the overall electrical conductivity of the formation and its contained fluid in such finite volume.

Referring to the drawings, FIG. 1 shows the surface of the earth 1 having a wellbore 2 extending downwardly thereinto and penetrating a subterranean geologic formation 3 which contains both hydrocarbonaceous fluids which are desirably produced into wellbore 2 or another wellbore 4 spaced from wellbore 2 or both. As is conventially practiced in the art, an energy source 5, e.g., an electrical generation, is employed on the earth's surface and connected by way of electrical conductor cable 6 to a downhole microwave radiation source 7 so that microwave radiation in generated in wellbore 2 in the vicinity of producing formation 3 thereby sending microwave radiation, as represented by arrows 8 and 8', outwardly into formation 3 to heat and thereby stimulate the production of hydrocarbonaceous fluids naturally present in formation 3. In the normal practice of the microwave heating process without the benefit of this invention, the microwave heating effect can cover a finite zone around wellbore 2 as shown by dotted lines 9. By the practice of this invention, the finite zone or volume within dotted lines 9 is more effectively heated by the microwave radiation 8 and 8' and, in addition, the finite volume of formation 3 affected by the microwave radiation can be extended substantially as shown by dotted lines 10. Thus, not only is more effective heating achieved but also a greater volume of hydrocarbonaceous fluid is subjected to the microwave heating process. When displacing fluid is injected into formation 3 by way of wellbore 2 as represented by arrow 11, the volume of formation 3 affected by the microwave radiation can be extended from that represented by 9 to that represented by 10. Since, as indicated earlier, the amount of hydrocarbonaceous fluid reserve in formation 3 is proportional to its distance from wellbore 2 squared, the substantial extension of the zone of influence of the microwave radiation from 9 to 10 affects a very large incremental addition of hydrocarbonaceous fluid in place in formation 3.

This invention can be practiced in an oil field with the standard "huff-n-puff" process or with a continuous injection of displacement fluid or both. When the huff-n-puff process is employed by itself, the injection of displacing fluid as represented by arrow 11, is periodically terminated to allow mobilized hydrocarbonaceous fluid present in formation 3 and within finite volume 10 to flow into wellbore 2 for production to the earth's surface by conventional equipment not shown in FIG. 1 for sake of clarity. If continuous injection of displacement fluid 11 is practiced, the mobilized hydrocarbonaceous fluid formation 3 will flow in through formation toward another wellbore, such as wellbore 4, for recovery in that wellbore and production to the earth's surface as represented by arrows 12 and 13.

A typical huff-n-puff approach that can be utilized in this invention injects a hydrocarbonaceous gas which is preferably highly soluble in the hydrocarbonaceous fluid already present in the formation to create a high gas saturation around wellbore 2 and thereby displace non-hydrocarbonaceous fluid away from the wellbore. During this gas injection step, formation 3 and fluids already contained therein around the wellbore are heated in a conventional manner by any downhole microwave device 7 currently commercially available. As the displacing gas is injected and the gas front in formation 3 moves outwardly thereinto and away from wellbore 2, the microwave radiation effectively heats larger and larger volumes of the formation and its contained fluids. At a desirable time, power source 5 is shut off and fluids in formation 3 allowed to back flow toward wellbore 2 until the hydrocarbonaceous fluid production rate in wellbore 2 declines to an unacceptable level. At that time, the foregoing steps are repeated as many times as desired. Note that with each subsequent huff-n-puff cycle the displacement gas front is moved further out into the reservoir so that ever increasing volumes of formation 3 are subjected to the beneficial effects of this invention as the huff-n-puff process steps are repeated.

For the well-to-well injection/production approach illustrated by wellbores 2 and 4, the microwave heating would be employed on an esentially continuous basis in injection well 2, and could also be employed on an intermittent basis in producing well 4 as well if desired. One technique within this invention would be to employ alternating slugs of natural gas displacing fluid and water in wellbore 2 along with continuous microwave heating. The water slugs would to improve the mobility of the natural gas displacement phase and would, in addition, carry residual heat picked up from the heated formation rock itself further out into the formation for heating as yet unmobilized hydrocarbonaceous fluid further out in the formation. This continuous injection of fluids in wellbore 2 would force mobilized hydrocarbonaceous fluids toward wellbore 4. A huff-n-puff operation could be conducted in producing wellbore 4 until displacement fluid injected in wellbore 2 breaks through into wellbore 4. When such breakthrough of injected fluid occurs at producing well 4, microwave heating would be discontinued, or at least reduced, to minimize overheating at wellbore 4. All microwave heating could be discontinued at the point where the produced hydrocarbonaceous fluid rate declined below an acceptable level.

Figure 2:
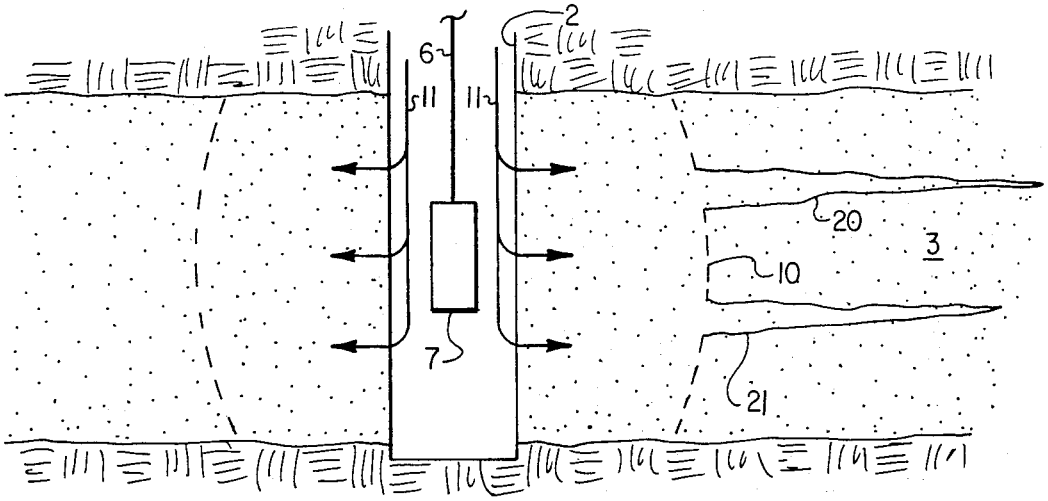
FIG. 2 is an enlarged cross section of a portion of the wellbore of FIG. 1.

Referring to FIG. 2, a section of the lower end of wellbore 2 of FIG. 1 which contains downhole microwave energy source 7 is shown along with the dispersement of displacement fluid 11 outwardly from wellbore 2 into formation 3 thereby creating the enlarged finite volume 10 of formation 3 which is affected by microwave radiation from source 7. If, as often occurs, due to subsurface heterogeneities, fracturing, or the like, the displacing fluid tends to finger further out into formation 3 as shown at 20 and 21, such fingering is not detrimental to the beneficial results of this invention like it is to conventional tertiary recovery processes. This is because the fingering of the displacement fluid of this invention out into formation 3 ahead of the displacement fluid front 10, although bad from a uniform fluid displacement point of view, is beneficial in this invention because microwave heating can occur in these fingers thereby providing heated fingers extending out into formation 3 ahead of front 10 with consequent mobilization of hydrocarbonaceous fluid in formation 3 even ahead of front 10.

Figure 3:
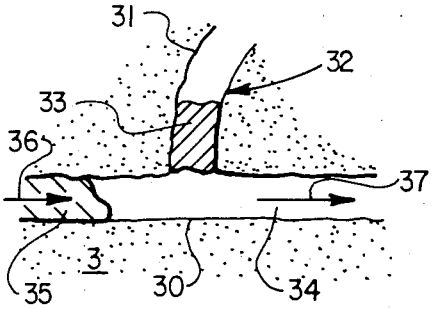
FIG. 3 is an even more enlarged section of a portion of the hydrocarbonaceous fluid containing formation before the displacement step of this invention.
Figure 4:
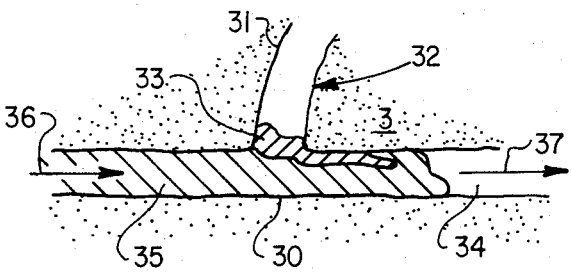
FIG. 4 is the same section formation of FIG. 3 after the dislacement step of this invention.

FIG. 3 shows a greatly enlarged section of formation 3 in which are shown two pores within the rock that forms the matrix of formation 3. One pore 30 is shown to be aligned, for sake of simplicity and clarity, essentially perpendicular to the long axis of wellbore 2 whereas branching pore 31 connects with pore 30 then curves off in another direction, thereby creating a restriction or bottleneck at 32. In pore 31, below restriction 32 is a trapped volume of hydrocarbonaceous fluid 33 that has been present in formation 3 since hydrocarbonaceous fluid migrated into same many millions of years earlier. Normally present in pore 30 is salt water or brine 34. The presence of this high electrical conductivity brine 34 reduces the impact of the microwave radiation heating on oil 33. However, in accordance with this invention, by the injection of a hydrocarbonaceous fluid 35 in the direction of arrow 36, brine 34 is displaced in the direction of arrow 37 until, as shown in FIG. 4, hydrocarbonaceous fluid 35 displaces brine 37 well away from oil 33. When this occurs, since hydrocarbonaceous fluid 35 is of a much lower electrical conductivity than brine 34, microwave radiation heating of well particle 33 is intensified thereby substantially lowering the viscosity of oil 33 so it can more readily flow out of pore 31 into pore 35 and then towards either wellbore 2 or 4.

Further, if fluid 35 is miscible with and/or dilutive of oil 33, fluid 35 can help wash particle 33 out of pore 31 and into pre 30 thereby supplementing the mobilizing effect of microwave radiation heating on oil 33.

It can be seen from this illustration that although, for example, crude oil and brine are intimately mixed throughout formation 3, sufficient brine can be displaced from a given volume of formation 3 around a wellbore to effectively reduce the electrical conductivity of that volume of formation, including its contained fluids, so that significantly more hydrocarbonaceous fluid present in that same volume of formation 3 can be reached, mobilized, and produced to a wellbore for recovery.

EXAMPLE

A huff-n-puff process is carried out using the apparatus essentially shown in FIG. 1 for wellbore 2 wherein during microwave heating of formation 2 natural gas at ambient temperature is injected into formation 3 at a rate of from 1 to 3 million standard cubic feet per day at a surface pressure of 500 psig which is below the fracture pressure of formation 3. Injection is carried out for 10 to 20 days after which the injection of natural gas is terminated. Gas injection remains terminated, but microwave heating is continued for 100 to 300 days to allow hydrocarbonaceous fluids in formation 3 to flow therefrom into wellbore 2 for pumping to the earth's surface by way of production tubing already in place in wellbore 2. These process steps are repeated a plurality of times until the volume of hydrocarbonaceous fluid produced from wellbore 2 reaches an uneconomical level. The downhole microwave source employed is a conventional source well-known in the prior art.

Reasonable variations and modifications are possible within the scope of this disclosure without departing from the spirit of this invention.

I claim:

1. In a method for stimulating the production of hydrocarbonaceous fluid from a subterranean geologic formation in the earth which contains both a hydrocarbonaceous fluid and a non-hydrocarbonaceous fluid which has a higher electrical conductivity than said hydrocarbonaceous fluid, said formation being penetrated by at least one wellbore, and microwave heating being employed in at least one wellbore to heat said formation and hydrocarbonaceous fluid contained therein to enhance the flow of said hydrocarbonaceous fluid into at least one wellbore for recovery of same at the surface of the earth, the improvement comprising displacing at least a portion of said non-hydrocarbonaceous fluid which is in said formation near said wellbore away from said wellbore and further into said formation, the amount of non-hydrocarbonaceous fluid displaced being that which is effective to substantially reduce the overall electrical conductivity of said formation and its contained fluids in a finite volume around said wellbore thereby to increase the effectiveness of said microwave heating in said finite volume and stimulate the movement of said hydrocarbonaceous fluid in the portion of said formation from which said nonhydrocarbonaceous fluid has been displaced.

2. The method of claim 1 wherein said non-hydrocarbonaceous fluid is essentially salt water.

3. The method of claim 1 wherein said non-hydrocarbonaceous fluid is displaced with a hydrocarbonaceous fluid.

4. The method of claim 3 wherein said hydrocarbonaceous fluid is one of liquid, gas, or a mixture thereof.

5. The method of claim 3 wherein said hydrocarbonaceous fluid is essentially natural gas.

6. The method of claim 3 wherein said hydrocarbonaceous fluid is esentially a liquid hydrocarbon.

7. The method of claim 6 wherein said liquid hydrocarbon has a viscosity greater than said non-hydrocarbonaceous fluid and less than said hydrocarbonaceous fluid.

8. The method of claim 1 wherein sufficient nonhydrocarbonaceous fluid is displaced from said finite volume to reduce by at least about ten percent the overall electrical conductivity of the formation and its contained fluids in said finite volume.

9. The method of claim 2 wherein said salt water is displaced from a finite volume around said wellbore by a hydrocarbonaceous fluid until the overall electrical conductivity of the formation and its contained fluids in said finite volume is reduced by at least about ten (10) percent.

10. The method of claim 1 wherein said displacement step is carried ou before said microwave heating is carried out, during said microwave heating, or both before and during said microwave heating.

* * * * *